US005927526A

United States Patent [19]

Herr

[11] Patent Number: 5,927,526

[45] Date of Patent: Jul. 27, 1999

[54] CHILD-RESISTANT ONE-PIECE CONTAINER AND ONE-PIECE CLOSURE ASSEMBLY

[75] Inventor: James Ellis Herr, E. Petersburg, Pa.

[73] Assignee: Kerr Group, Inc., Lancaster, Pa.

[21] Appl. No.: 08/873,152

[22] Filed: Jun. 11, 1997

Related U.S. Application Data

[63] Continuation of application No. 08/551,186, Oct. 31, 1995, Pat. No. 5,671,853.

[51] Int. Cl.[6] ..... B65D 55/02

[52] U.S. Cl. ..... 215/216; 215/221

[58] Field of Search ..... 215/216, 221

[56] References Cited

U.S. PATENT DOCUMENTS

| | | | |
|---|---|---|---|
| D. 330,677 | 11/1992 | Thornock et al. . | |
| 3,888,375 | 6/1975 | Gerk . | |
| 3,917,097 | 11/1975 | Uhlig . | |
| 3,941,268 | 3/1976 | Owens et al. . | |
| 3,984,021 | 10/1976 | Uhlig . | |
| 3,989,152 | 11/1976 | Julian | 215/216 |
| 3,993,208 | 11/1976 | Ostrowsky . | |
| 4,149,646 | 4/1979 | Julian | 215/216 |
| 4,752,013 | 6/1988 | Miller et al. | 215/216 |
| 4,752,014 | 6/1988 | House et al. | 215/216 |
| 4,948,002 | 8/1990 | Thornock et al. . | |
| 5,038,454 | 8/1991 | Thornock et al. . | |
| 5,230,433 | 7/1993 | Hamilton et al. . | |
| 5,383,564 | 1/1995 | Hamilton et al. . | |
| 5,413,233 | 5/1995 | Hall . | |
| 5,449,077 | 9/1995 | Seidler | 215/216 |
| 5,460,281 | 10/1995 | Rapachak et al. . | |
| 5,462,182 | 10/1995 | Opresco | 215/216 |

FOREIGN PATENT DOCUMENTS

| | | |
|---|---|---|
| 2001079 | 4/1990 | Canada . |

*Primary Examiner*—Stephen Cronin
*Attorney, Agent, or Firm*—Kenyon & Kenyon

[57] ABSTRACT

A child-resistant closure container system allowing easy opening by debilitated adults. The closure has moveable panels on the side wall which, when depressed, allow the unscrewing of the closure from the neck of the jar or vial. The moveable panels include tabs engaging stationary locking lugs on the neck finish annulus, which prevent removal of the closure without depressing the tabs. The annulus and stationary locking lugs can be an integral part of the jar or vial.

14 Claims, 6 Drawing Sheets

CHILD-RESISTANT ONE-PIECE CONTAINER AND ONE-PIECE CLOSURE ASSEMBLY

This application is a continuation of application Ser. No. 08/551,186, filed on Oct. 31, 1995 now U.S. Pat. No. 5,671,853.

BACKGROUND OF THE INVENTION

1. Field of the Invention

The present invention relates to a child-resistant container closure system which provides easy opening by adults, even debilitated adults, but nevertheless requires manipulation which renders the closure resistant to opening by children. The present invention is composed of an easy-to-manufacture one-piece container and a closure for that container.

2. Discussion of the Prior Art

Child-resistant packaging is used to prevent inadvertent access by children to potentially dangerous materials such as medications, chemicals or poisons. Providing child-resistant packaging often adds cost and can result in the packaging being difficult for an adult user to open. This difficulty in opening child-resistant packaging is compounded when an adult attempting to open the package is debilitated or has reduced manual dexterity in one or more hands as a result of, e.g., arthritis. Elderly persons tend to rely on medication more than the average person, and also tend to have impaired manual strength and dexterity because of arthritis or age. Therefore, elderly persons can have a more difficult time opening child-resistant packaging.

Child-resistant packages exist in the prior art. For example, U.S. Pat. No. 3,917,097 to Uhlig describes a closure with internal flanges engaging abutments on the container. Disengagement of the abutments and flanges is accomplished by pressing opposing finger indentations to flex the flanges out of engagement with the abutments, and thereafter rotating the closure. Flexing of the flanges in this device requires deformation of the circumference of the closure by the user's fingers.

U.S. Pat. No. 3,984,021, also to Uhlig, and U.S. Pat. No. 3,941,268 to Owens et al. describe closures with internal tabs which engage abutments on the container. Again, disengagement of the tabs and abutments is accomplished by flexing opposing sides of the closure until the tabs and abutments disengage, and then rotating the closure. A similar concept is described in U.S. Pat. No. 3,993,208 to Ostrowsky. These devices also require flexing of the closure circumference to disengage the locking feature.

Finally, U.S. Pat. No. 5,230,433 to Hamilton et al. describes a closure with pawls which engage push-tab extensions projecting from a sleeve mounted on the container. Disengagement is accomplished by pressing the opposing push-tabs and rotating the closure.

Each of the above prior art closures suffer from at least the disadvantage that they are not easy to remove by debilitated adults, because they require significant force to flex the outer circumference of the closure portion to disengage the locking mechanisms between the closure and the container.

U.S. Pat. No. 4,948,002 and U.S. Pat. No. Design 330,677 also disclose child-resistant packages. These packages suffer from the disadvantage that the part of the package which must be manipulated to disengage the locking portion is on the container. As a result, the user must manipulate the container in one hand to disengage the locking feature, and must manipulate the closure in the other hand by rotating the closure to unscrew it from the container. Thus, manual dexterity in both hands is required to remove the closure, making the closure difficult to remove for those who may be more debilitated in one hand. These packages are also difficult to manufacture because they use a complicated two-piece container assembly as well as a one-piece closure assembly fitting on the container assembly.

SUMMARY OF THE INVENTION

It is an object of the present invention to provide a child-resistant closure and container combination that prevents access to the contents of the container by children yet is relatively easy to remove by an adult, even by a debilitated adult having manual dexterity in only one hand. In addition, it is an object of the present invention to provide a child-resistant package which is easy and economical to manufacture and assemble.

The present invention is a combination of a closure and a container. The closure has a top wall, an annular skirt, and a closure thread located in the interior of the closure. At least one depressible moveable panel is molded into the annular skirt, and one locking tab is formed on each moveable panel. The moveable panels are spaced from the skirt by gaps, which make the moveable panels more easily radially deformable by the user's fingers. Preferably two or more moveable panels and locking tabs are provided on the closure.

The container includes a receptacle portion for holding the contents. A threaded neck projects upwardly from the receptacle portion. An annulus encircles the neck, and includes at least one stationary locking lug. The annulus may be formed by the top shoulder of the container. Preferably two stationary locking lugs are provided on the annulus. The stationary locking lugs engage the locking tabs on the closure such that the locking tabs prohibit rotation of the closure off of the container neck unless the movable panels are repressed.

The closure and the container may each be made of plastic, although the container may alternatively be made of glass. The closure thread which secures the closure to the container may be on an annular threaded skirt which projects from the top wall of the closure. The annular threaded skirt and the annular skirt are substantially concentric.

The annular skirt may be serrated or have ribs for ease of gripping by the user. Advantageously there are two each of the moveable panels, the locking tabs, and the stationary locking lugs. The movable panels are advantageously each located 180 degrees apart on the circumference of the closure.

Typical products which may be held inside the child-resistant container of the present invention include, but are not limited to, liquid or solid medicines, pills, prescriptions, treatments, as well as soaps, detergents, pesticides, poisons, solvents, industrial chemicals and the like.

The closure and container combination according to the present invention is capable of manufacture with conventional equipment used in the manufacture of containers, both glass and plastic, without any substantially burdensome modifications to that equipment. Conventional plastic or glass molding techniques may be used to construct the package of the present invention without difficulty. The container may be manufactured, e.g., by standard bottle injection molding machines.

The closure and container combination of the present invention has numerous advantages. First, it can be easily manufactured as a one-piece bottle and one-piece closure. Second, there is no need to manipulate both the bottle and closure to open the package. The closure of the present invention is advantageously designed with movable panels, which allows the closure to be threaded onto the container using automatic threading machinery without additional equipment for manipulating the closure or the container. Finally, the package does not require significant flexing force to disengage the locking portions.

DETAILED DESCRIPTION

FIGS. 1–13 show the construction of a child-resistant closure and container combination of the present invention. A closure 110 is mounted on a container 150 through interengaging threads 154, 232, so as to prevent access to the contents of the container.

Figure 2:
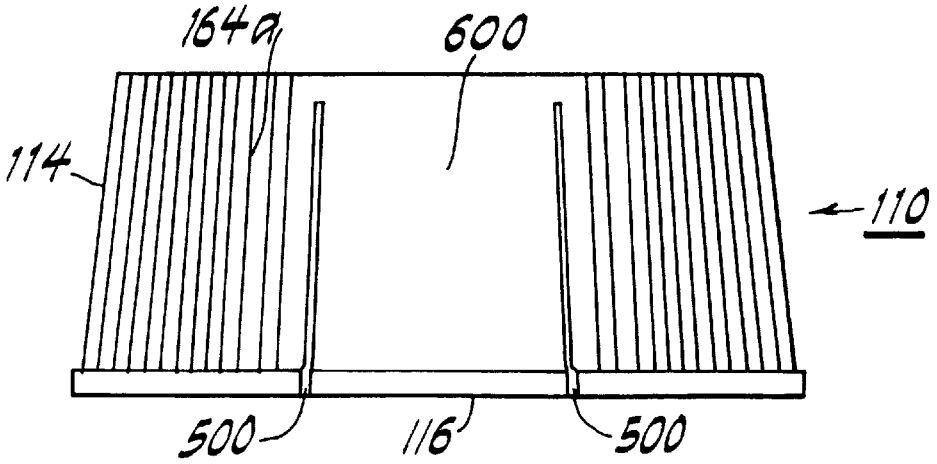
FIG. 2 shows a side view of a first embodiment of a closure of the present invention.
Figure 3:
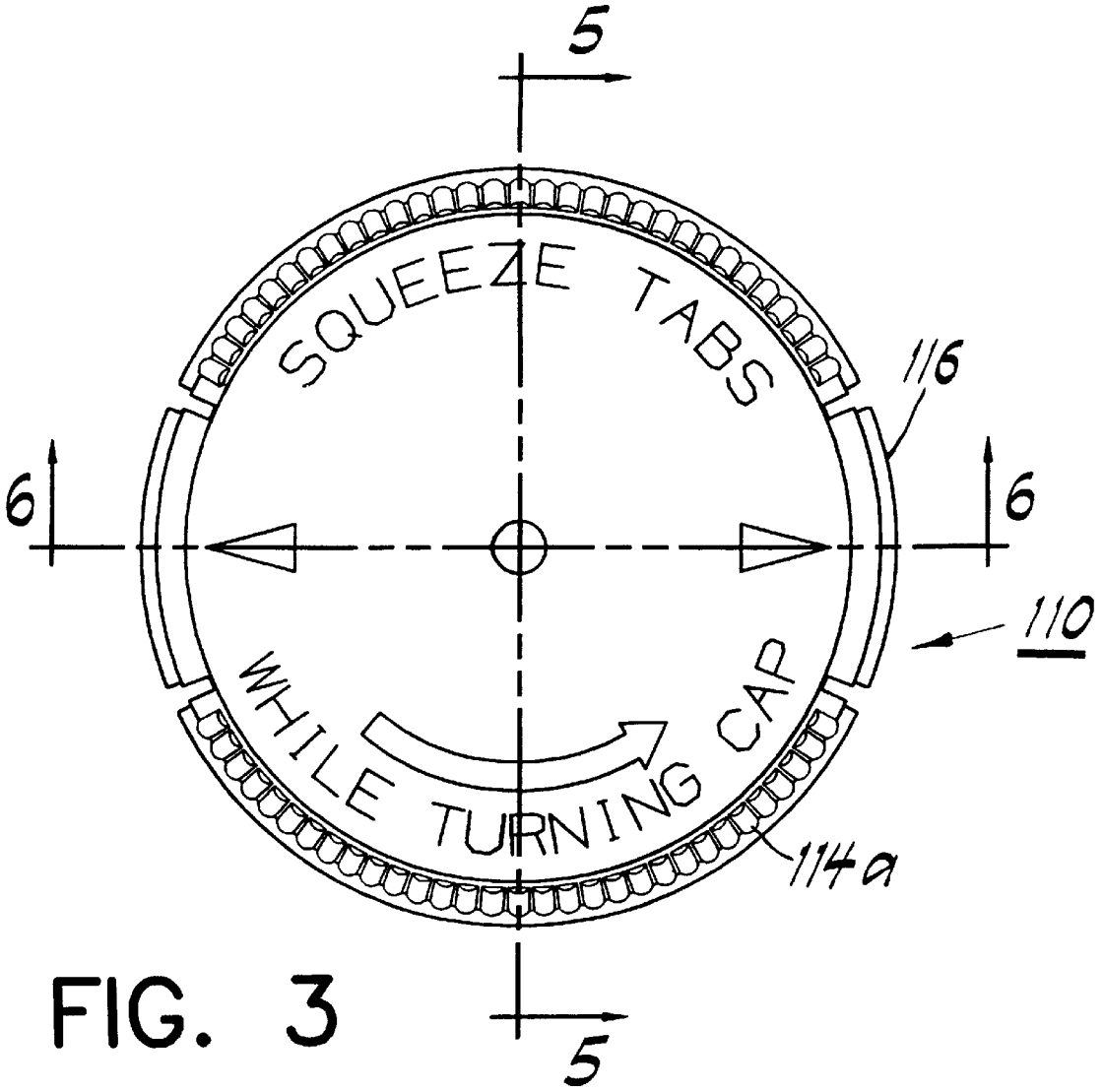
FIG. 3 shows a top view of the closure of FIG. 2.
Figure 5:
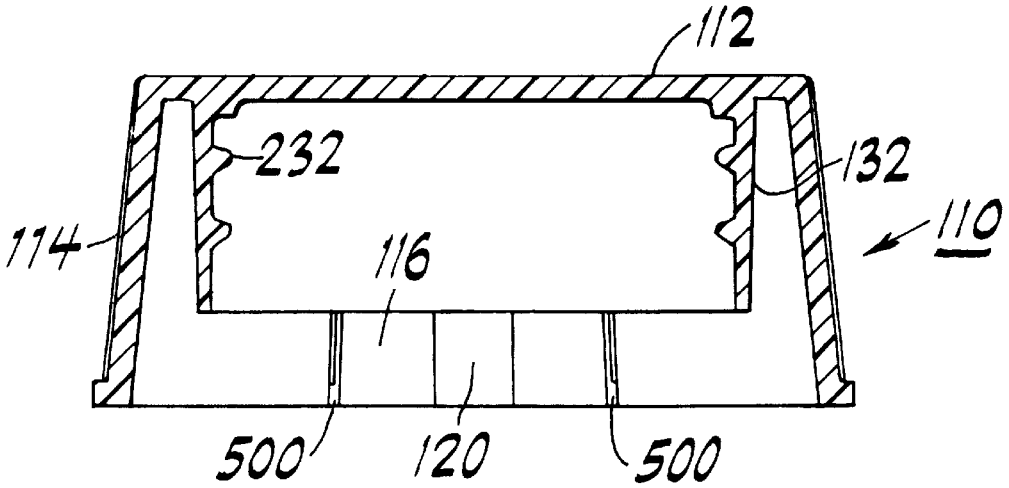
FIG. 5 shows a cross-sectional side view, along line V—V, of the closure of FIG. 3.
Figure 4:
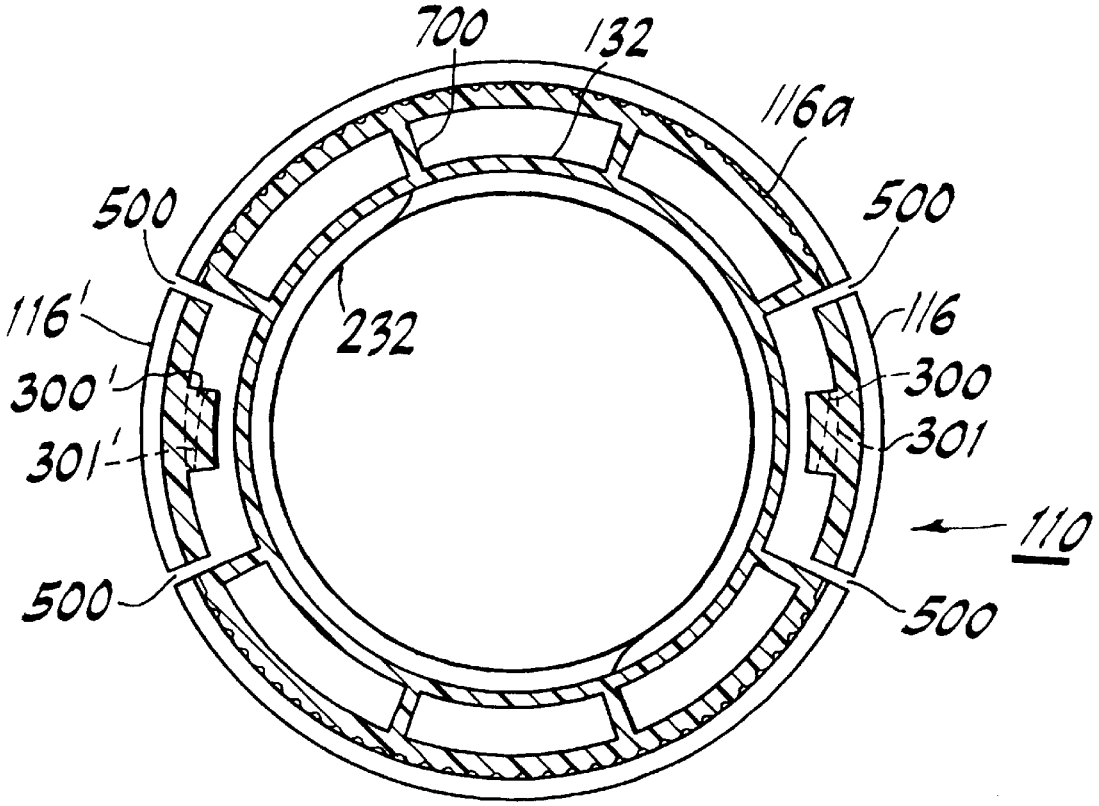
FIG. 4 shows a cross-sectional view, along line IV—IV, of the closure of FIG. 2, and shows the locking tabs of the closure.

The closure 110 includes top wall 112, which is generally circular in shape. Projecting from top wall 112 is annular skirt 114. In the closure of FIG. 2, annular skirt 114 is flared out, allowing a wider range of radial movement of the moveable panels 116, 116'. A wider range of radial movement for moveable panels 116, 116' makes them less easily manipulable by the small hands of children, thereby ensuring that the closure is especially secure against removal by a child. Annular skirt 114 includes at least one radially-flexible locking device, such as moveable panel 116. Preferably two moveable panels 116, 116' are provided, although other numbers are possible. Annular skirt 114 may include serrations or ribs 114*a*, which make gripping the closure 110 easier. The outer surface of the movable panels 116, 116' should preferably not include serrations or ribs, thereby distracting children from gripping or manipulating the movable panels 116, 116'. Molded to a radially inner surface of each of the moveable panels 116, 116' is a locking tab 120, which may have a rectangular cross-section, or may have one surface formed as a circular arc 300. (see FIGS. 8 and 12) The circular arc 300, 300' of locking tabs 120, 120' can ease the locking tab 120, 120' over the stationary locking lugs 164, 164' during tightening of closure 110 on container neck 152. A portion of the locking tabs 120, 120' closest to the top wall 112 is molded integrally to the moveable panels 116, 116' at web 301, 301'. The other portion of the locking tabs 120, 120' is spaced from the moveable panel 116, 116' by gaps G, G'. The gaps G, G' between the locking tabs 120, 120' and the moveable panels 116, 116' allow the locking tabs 120, 120' to flex in the radial direction, thereby allowing the locking tabs 120, 120' to flex around stationary locking lugs 164, 164' during tightening of the closure 110 on container 150. The stationary locking lugs 164, 164' pass through the gaps G, G' during tightening of the closure 110 on the container neck 152.

Figure 6:
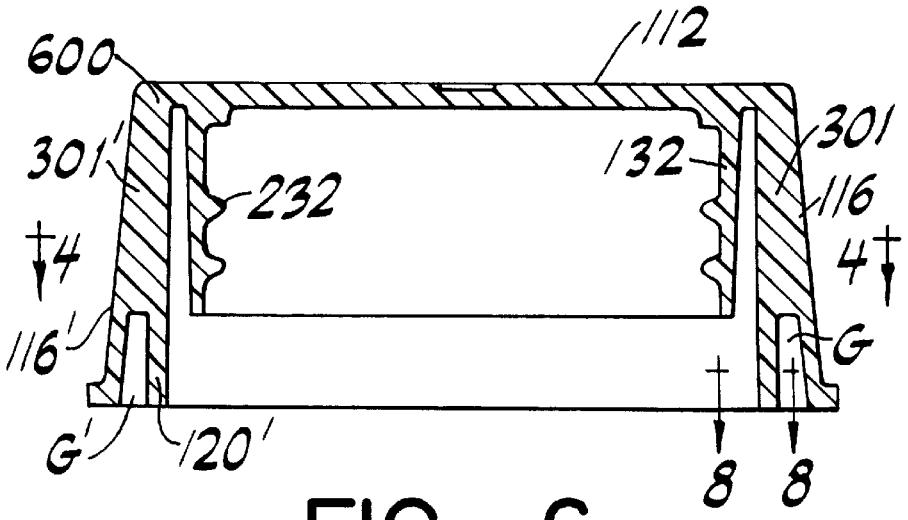
FIG. 6 shows a cross-sectional side view, along line VI—VI, of the closure of FIG. 3.

FIG. 6 shows a cross-section of the closure, showing the interior of the closure. Annular threaded skirt 132 projects from the cop wall 112 and is generally concentric with annular skirt 114. The threads 232 on threaded skirt 132 engage corresponding threads 154 on a container neck 152 to hold the closure 110 onto the container 150. The threads 232 must be of sufficient length to ensure that locking tabs 120, 120' ride over stationary locking lugs 164, 164' when the closure 110 is tightened on container neck 152. The closure 110 may include stabilization webs 700, which provide stability between the annular skirt 114 and the annular threaded skirt 132.

In addition, the thread system on the closure 110 and container 150 may include multiple threads. Two or more separate threads may be included on each of the closure 110 and the container 150. U.S. Pat. No. 5,213,225 teaches such a system, in which the threads only circle the closure and container neck a fraction of a circumference. Using this system, the closure only requires a partial rotation in order to be removed from the container neck. This "quick-off" feature may be advantageous for those users who encounter difficulty when opening containers.

Figure 1:
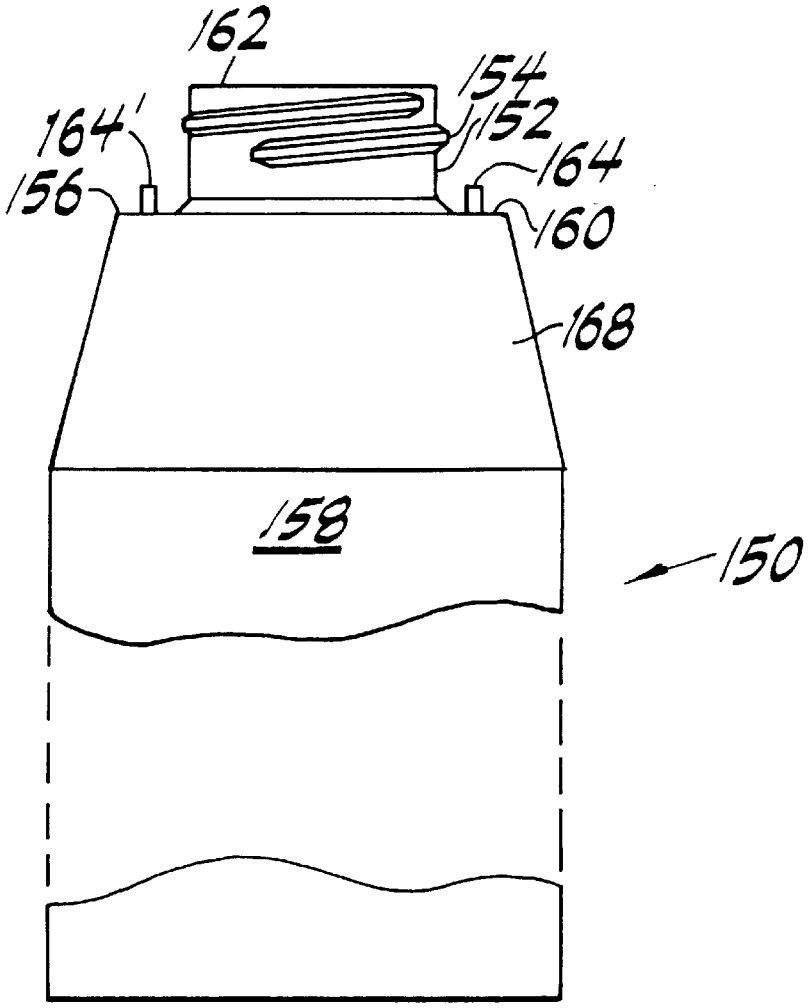
FIG. 1 shows a side view of a first embodiment of the container portion of the present invention.
Figure 7:
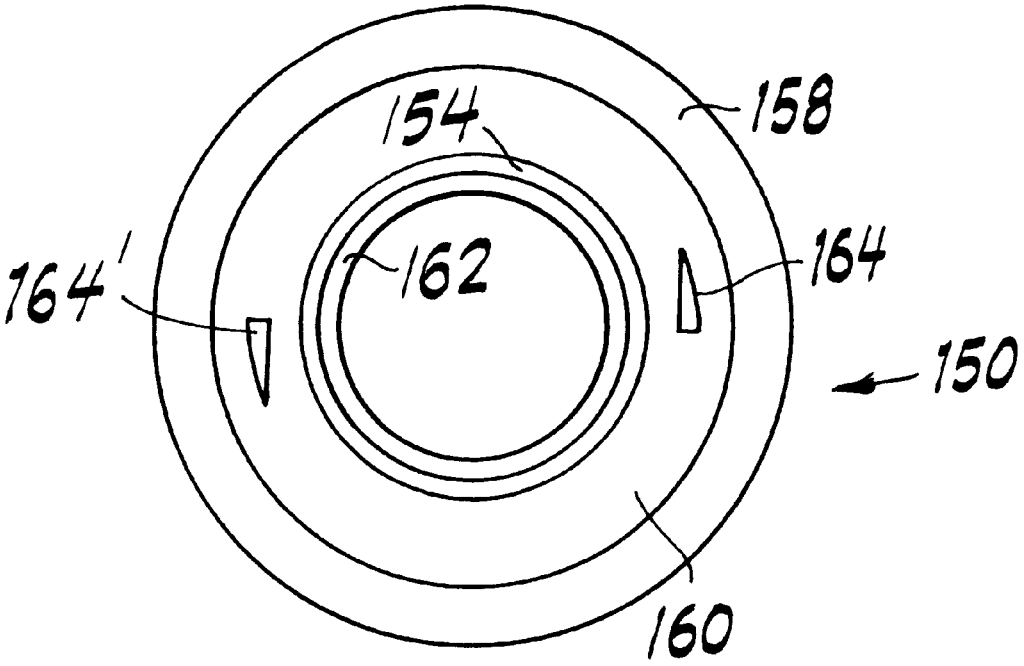
FIG. 7 shows a top view of the container of FIG. 1.
Figure 12:
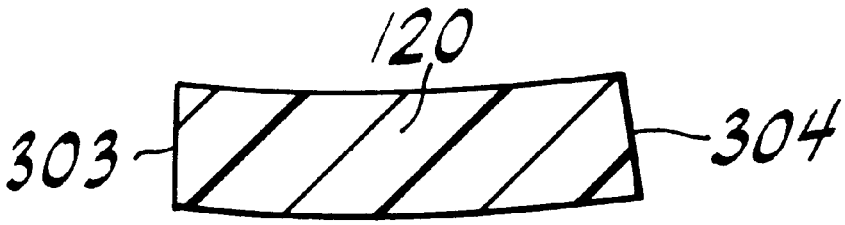
FIG. 12 shows an alternative embodiment of the locking tab of the present invention.

The structure of a container according to an embodiment of the present invention is generally shown in FIGS. 1 and 7. In FIG. 1, container 150 is shown as having a containing portion 158. The neck 152 extends upwardly from the container shoulder 168. This neck 152 has an annular lip 162 defining an opening through which the contents of the container 150 may be dispensed. Surrounding neck 152 is at least one container thread 154. Thread 154 engages a corresponding thread 232 on the closure 110 to secure the closure 110 on the container 150.

Figure 10:
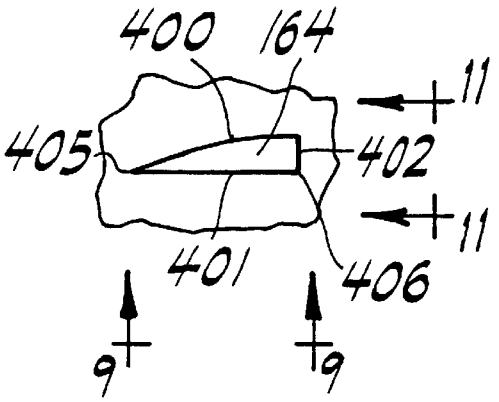
FIG. 10 shows a top detail view of a stationary locking lag of the present invention.
Figure 8:
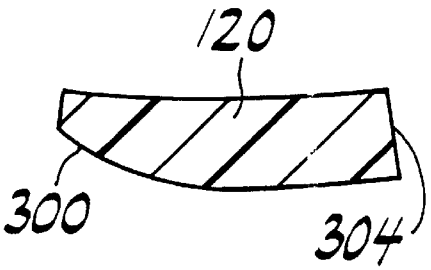
FIG. 8 shows a detail cross-sectional view, along line VIII—VIII, of the moveable panel area of the closure of FIG. 6.
Figure 9:
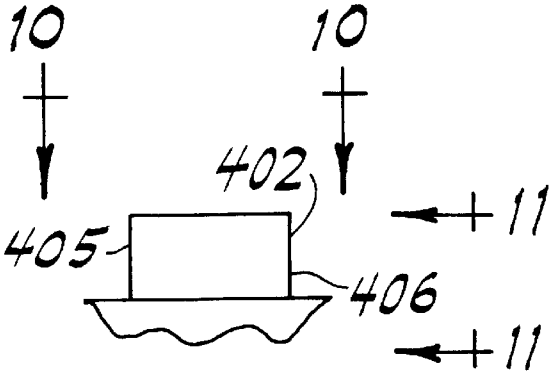
FIG. 9 shows a side detail view of a stationary locking lag of the present invention.
Figure 11:
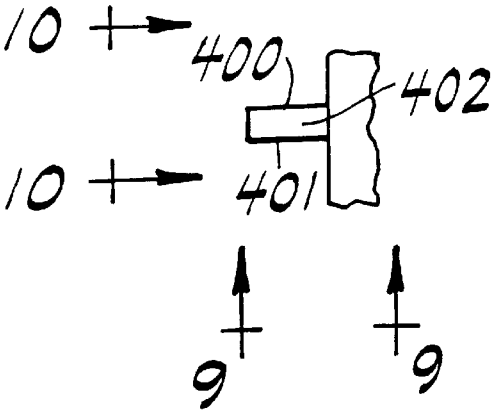
FIG. 11 shows an end-on detail view of a stationary locking lag of the present invention.
Figure 13:
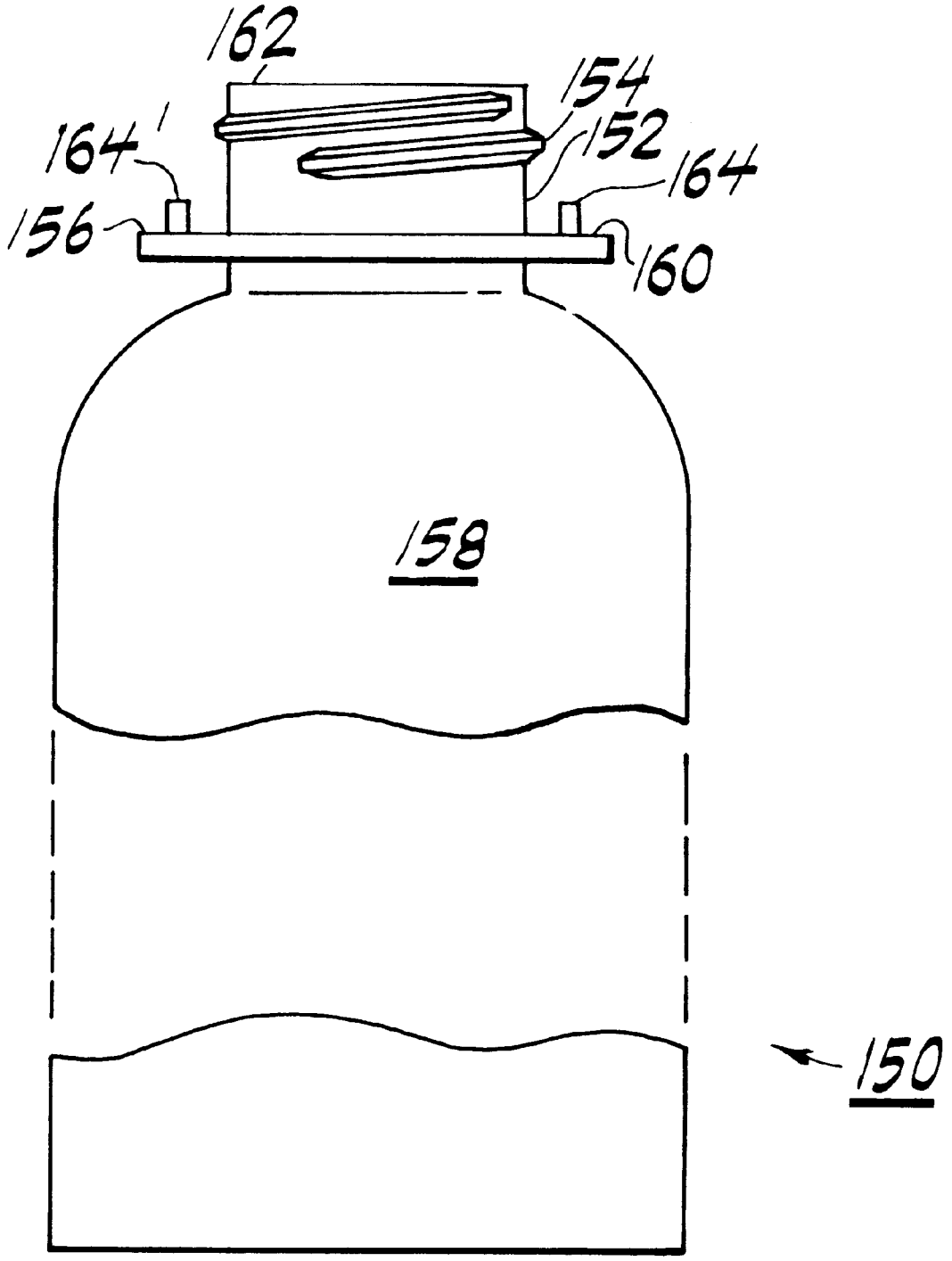
FIG. 13 shows an alternative embodiment of the container of the present invention.

Flaring outward from neck 152 is annulus or extension 160. Extension 160 has an outer perimeter 156 which merges with container body 158. Extension 160 may be defined by a generally flat ring-shaped annulus or floor concentric with the axis of the container 150 (FIG. 1), or may be a flange projecting from the container neck 152 (FIG. 13). Mounted onto extension 160 is at least one stationary locking lug 164. In FIG. 1, two stationary locking lugs are shown, 164 and 164'. As shown in FIG. 10, the stationary locking lugs 164, 164' have a radially outer surface 400. Outer surface 400 is shaped in the form of a circular arc with a centerpoint corresponding to the axis of the container 150. A locking face 402 extends along a radius of the container 150 axis. An inner surface 401 is is preferably formed perpendicular to the locking face 402. Inner surface 401 need not be perpendicular to locking face 402, however, and need only be a surface which, from its leading edge 405 to its trailing edge 406, projects radially inwardly. This radial inward projection of inner surface 401 ensures that the locking tabs 120, 120' will be deformed radially inwardly as they ride over the stationary locking lugs 164, 164'. The inner surface 402 is preferably formed on a parting line of the mold used to make the container 150.

In operation of the closure 110 of the present invention, as the closure 110 is rotated on the threads 154 in a tightening direction, the circular arc 300, 300' of locking tabs 120, 120' (or in the embodiment of FIG. 12, the leading corner 303 of locking tab 120) contacts the inner surface 401 of the stationary locking lug 164 at leading edge 405. Further rotation of the closure 110 in the tightening direction flexes the locking tabs 120, 120' radially inwardly, such that the radially outer surface of locking tabs 120, 120' slides along the inner surface 401. As the locking tabs 120, 120' slide along the inner surface 401, the stationary locking lugs 164, 164' pass into the gap G between the moveable panels 116, 116' and the locking tabs 120, 220'. After the locking tabs 120, 120' have slid over inner surface 401, the locking tabs 120, 120' snap radially outwardly, such that the trailing surfaces 304 of locking tabs 120, 120' engage locking face 402 of stationary locking lugs 164, 164'. The engagement between trailing surface 304 and locking face 402, both of which are located along a radius of the container 150 axis, prevents reverse rotation of the closure 110 relative to the container without manipulation of the moveable panels 116, 116'.

To disengage the closure 110 from the container 150, a user places a finger on each moveable panel 116, 116' and depresses the moveable panels 116, 116'. The moveable panels 116, 116' easily flex radially inwardly because of the gaps 500 between the moveable panels 116, 116' and the annular skirt 114. These gaps ensure that the force necessary to disengage the locking lugs 120, 120' is only that force necessary to flex the moveable panels 116, 116' against the resistance of the moveable panel hinge 600. This radial movement causes the radially outward face of locking tabs 120, 120' to be placed radially inward of the inner face 401 of the stationary locking lugs 164, 164'. Rotation of the closure in an untightening direction causes the stationary locking lugs 164, 164' to pass into the gaps G between the moveable panels 116, 116' and the locking tabs 120, 120'. In this position, the locking tabs 120, 120' may be rotated past the stationary locking lugs 164, 164', upon an untightening rotation of the closure 110 relative to the container 150. After the locking tabs 120, 120' pass the stationary locking lugs 164, 164', the closure 110 may be unscrewed off the container neck 152 in a known manner.

The use of locking tabs 120 allows depression of moveable panels 116 to directly move each locking tab 120 out of engagement with stationary locking lugs 164 and 164'. In this way, the user has far more control over the disengagement of the child-resistant feature than when the locking tab is only indirectly manipulated. Furthermore, because perimeter 156 may be made to be flush with annular skirt 114, a pleasing overall appearance is provided by the continuous character of the container 150 and closure 110. However, because of the gaps 500 between the moveable panels 116, 116' and the annular skirt 114 as well as the moveable panel hinge 600 connecting the moveable panels 116, 116' to the top wall 112, the locking mechanism is much easier to disengage than a closure in which the circumference of the closure must be deformed to unlock the locking mechanism.

It is, of course, understandable and to be expected that variations in the principles of construction disclosed herein in the embodiment may be made by one skilled in the art and it is intended that such modifications, changes, and substitutions are to be included within the scope of the present application. For example, while two stationary locking lugs and two locking tabs have been shown in the pictured embodiments, any number of such features are contemplated by the closure and container combination of the present invention. The scope of the present application is limited only by the language of the claims appended hereto.

What is claimed is:

1. A multi-component package for safely storing contents to be reached only by manipulation of the package, the package comprising:

a closure including;

a top wall;

a skirt projecting from the top wall;

a radially flexible locking element including a locking tab, the locking element being mounted on the closure for movement relative to the skirt, the locking tab being connected to the locking element by a web at one location and the locking tab being spaced from the locking element at another location by a gap; and a closure thread located within an interior of the closure; and a container including;

a receptacle portion;

a threaded neck projecting axially from the receptacle portion;

an extension, mounted on the container and projecting away from the receptacle portion, having an abutting element for engaging the locking tab, engagement between the abutting element and the locking tab prohibiting rotational disengagement of the closure from the container, the closure being locked onto the container unless the locking tab is moved in a radial direction near the bottom of the skirt towards a center of the closure simultaneously with rotation of the closure.

2. The package of claim 1, wherein said closure and said container are made of plastic.

3. The package of claim 1, wherein said closure is made of plastic and said container is made of glass.

4. The package of claim 1, wherein said radially flexible locking element comprises a moveable panel.

5. The package of claim 1, further comprising an annular threaded skirt projecting from said top wall, an interior of said annular threaded skirt comprising said closure thread.

6. The package of claim 5, wherein said annular threaded skirt and said annular skirt are substantially concentric.

7. The package of claim 1, comprising two said radially flexible locking elements and two said abutting elements.

8. The package of claim 7, wherein said radially flexible locking elements are circumferentially spaced 180 degrees apart and said abutting elements are circumferentially spaced 180 degrees apart.

9. A multi-component package for safely storing contents to be reached only by manipulation of the package, the package comprising:

a closure including;

a top wall;

a skirt projecting from the top wall;

a radially flexible locking element including a locking tab, the locking element being mounted on the closure for movement relative to the skirt, the locking tab being connected to the locking element by a web at one location and the locking tab being spaced from the locking element at another location; and a closure thread located within an interior of the closure; and a container including;

a receptacle portion;

a threaded neck projecting axially from the receptacle portion;

an extension, mounted on the container and projecting away from the receptacle portion, having an abutting element for engaging the locking tab, engagement between the abutting element and the locking tab prohibiting rotational disengagement of the closure from the container, the abutting element including a radially inner surface which projects radially inwardly from a leading edge to a trailing edge, the closure being locked onto the container unless the locking tab is moved in a radial direction near the bottom of the skirt towards a center of the closure simultaneously with rotation of the closure.

10. A closure and container combination, comprising:

a closure, including;

a top wall;

a depending annular skirt;

at least one closure thread;

at least one depressible movable panel separated from the annular skirt by at least one molded-in gap extending along the axial length of the skirt, the movable panel being connected to the closure by a hinge; and at least one locking tab molded integrally with the at least one movable panel, the at least one locking tab including a trailing surface; and a container, the container including;

a receptacle portion;

a threaded neck projecting from the receptacle portion; and an annulus adjacent to and encircling the neck, the annulus having located thereon at least one stationary locking lug, the stationary locking lug including a locking face, the stationary locking lug engaging the at least one locking tab upon rotation of the closure thread on the threaded neck in a first direction until the locking face engages the trailing surface, the engagement between the locking face and the trailing surface prohibiting rotation of the closure thread on the threaded neck in a direction opposite the first direction unless the at least one moveable panel is depressed radially inward.

11. The combination of claim 10, wherein:

the locking tabs are connected to the movable panels by a web at one axial location, and wherein the locking tabs are spaced from the movable panels by a gap at another axial location.

12. The combination of claim 10, wherein the at least one stationary locking lug includes a radially inner surface which projects radially inwardly from a leading edge to a trailing edge.

13. The combination of claim 10, further comprising:

two of the movable panels, two of the locking tabs, and two of the stationary locking lugs.

14. The combination of claim 13, wherein:

the locking tabs are circumferentially spaced 180 degrees apart, and the stationary locking lugs are circumferentially spaced 180 degrees apart.

* * * * *